US006769734B2

(12) United States Patent
Tacker

(10) Patent No.: US 6,769,734 B2
(45) Date of Patent: Aug. 3, 2004

(54) HEADREST POP-UP LINKAGE FOR A CHAIR MECHANISM

(75) Inventor: Bill Tacker, Smithville, MS (US)

(73) Assignee: L & P Property Management Company, South Gate, CA (US)

( * ) Notice: Subject to any disclaimer, the term of this patent is extended or adjusted under 35 U.S.C. 154(b) by 34 days.

(21) Appl. No.: 10/167,255

(22) Filed: Jun. 11, 2002

(65) Prior Publication Data

US 2003/0227197 A1 Dec. 11, 2003

(51) Int. Cl.[7] ..... A47C 1/02

(52) U.S. Cl. ..... 297/61; 297/85; 297/273.1; 297/DIG. 7

(58) Field of Search ..... 297/61, 68, 85, 297/88, 271.3, DIG. 7, 259.2, 403

(56) References Cited

U.S. PATENT DOCUMENTS 3,652,125 A * 3/1972 Rogers, Jr. ..... 297/61
3,847,430 A * 11/1974 Fletcher ..... 297/61
3,856,346 A * 12/1974 Herman ..... 297/61
3,865,432 A * 2/1975 Rogers et al. ..... 297/316
3,871,705 A * 3/1975 Harrison ..... 297/61
3,937,518 A * 2/1976 Harrison ..... 297/61
3,942,835 A * 3/1976 Harrison ..... 297/61
3,958,827 A * 5/1976 Re ..... 297/61
4,519,647 A 5/1985 Rogers, Jr.
4,736,984 A 4/1988 Tacker
4,805,960 A 2/1989 Tacker
4,878,710 A 11/1989 Tacker
4,919,478 A 4/1990 Tacker
5,310,243 A * 5/1994 Pine ..... 297/61
RE34,666 E 7/1994 Tacker
5,360,255 A 11/1994 Cook et al.
5,527,092 A 6/1996 Cook et al.
6,000,754 A * 12/1999 Lawson ..... 297/259.2

* cited by examiner

*Primary Examiner*—Laurie K. Cranmer
(74) *Attorney, Agent, or Firm*—Shook, Hardy & Bacon LLP

(57) ABSTRACT

A rocker recliner linkage mechanism having a headrest pop-up linkage is provided. The pop-up linkage includes a headrest drive link, a headrest bell crank and a toggle link. The headrest bell crank couples the headrest drive link to the toggle link and is pivotally coupled with a back support linkage. The headrest drive link is coupled with the drive linkage, and the toggle link is coupled with the headrest mounting linkage. The pop-up linkage utilizes the movement of drive linkage to move the headrest mounting linkage between the closed position to the support position as the chair moves between upright and intermediate positions. The pop-up linkage is also adapted to maintain the position of the headrest relative to the backrest as the chair is moved between intermediate and fully reclined positions.

47 Claims, 7 Drawing Sheets

HEADREST POP-UP LINKAGE FOR A CHAIR MECHANISM

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to a linkage mechanism for a rocker recliner chair. More particularly, this invention relates to a linkage mechanism for a rocker recliner chair that is capable of moving a headrest between closed and support positions as the chair moves between upright, intermediate and fully reclined positions.

Chair headrests are well known in the art. A typical chair headrest is mounted to the top of a backrest and is not capable of being moved relative to the backrest of the chair. However, there are other types of headrests available that are capable of moving relative to the backrest. For example, an automobile headrest can be manually moved upward or downward relative to the backrest to provide an adjustable head support for a passenger.

In addition, it is well known that stationary recliner chairs or zero wall chairs are also capable of moving the headrest relative to the backrest. In particular, the stationary chairs include a linkage mechanism that operates to move the headrest between retracted and extended positions when the chair is moved between upright and reclined positions. The linkage mechanisms used in the stationary recliners are able to move headrest relative to the backrest due to the long pivot lengths of the linkages, the large number of moving parts and the translation distances of the linkages when the chair moves between upright and reclined positions. The amount of mechanical advantage available in these types of chair mechanisms makes it relatively easy to move the headrest relative to the backrest.

However, it has been difficult to provide a chair mechanism that can be used with a rocker recliner chair that operates to move a headrest relative to a backrest. Specifically, the linkages that are used in rocker recliner chairs have smaller pivot lengths and translation distances compared to the linkages in the stationary chair when the chairs are moved between upright, intermediate and fully reclined positions. The smaller pivot lengths and translation distances produce a limited amount of torque and mechanical advantage to move the headrest relative to the backrest. Due to the limited amount of torque and mechanical advantage available in the rocker recliner, there have been very few attempts, if any, to provide for a chair mechanism that will move a headrest between retracted and extended positions.

Accordingly, there remains a need for a linkage mechanism for a rocker recliner chair that is capable of moving a headrest between closed and support positions as the chair is moved between upright, intermediate and fully reclined positions. The present invention fills these needs as well as various other needs.

BRIEF SUMMARY OF THE INVENTION

In order to overcome the above-stated problems and limitations, and to achieve the noted objects, there is provided a rocker recliner chair that operates to move a headrest between a closed position and a support position as the chair moves between upright, intermediate and fully reclined positions.

In general, the rocker-recliner chair includes a base, a rocker cam assembly mounted on the base, a seat, a footrest, a backrest and a headrest and a pair of linkage mechanisms mounted to the base on opposite sides of the chair. Each linkage mechanism includes a seat mounting linkage that couples the seat to the rocker cam assembly. A footrest extension linkage is coupled with the seat mounting linkage and has the footrest mounted thereon. The seat mounting linkage is coupled with the footrest extension linkage by a drive linkage that is adapted to drive the footrest extension linkage from a retracted position to an extended position. The backrest is mounted to a back support linkage which is in turn coupled to the seat mounting linkage. A headrest mounting linkage is coupled with the back support linkage and is adapted to have the headrest mounted thereon.

A pop-up linkage is pivotally mounted to the drive link and is adapted to move the headrest between closed and support positions. The pop-up linkage includes a headrest drive link, a headrest bell crank and a toggle link. The headrest bell crank couples the headrest drive link to the toggle link and is pivotally coupled with the back support linkage. The headrest drive link is coupled with the drive linkage, and the toggle link is coupled with the headrest mounting linkage. The pop-up linkage is adapted to move the headrest mounting linkage from the closed position to the support position as the chair moves between upright and intermediate positions. In particular, the pop-up linkage utilizes the movement of the drive linkage as it moves the footrest extension linkage from the retracted position to the extended position to drive headrest into the support position. The pop-up linkage also uses the movement of drive linkage as the footrest is moved to a retracted position to move the headrest to a closed position. The pop-up linkage is also adapted to maintain the position of the headrest relative to the backrest as the chair is moved between intermediate and fully reclined positions.

Additionally, the linkage mechanism may further include a spring coupled between the headrest drive link and the back support linkage for biasing the pop-up linkage toward the support position. Still further, the chair may include a first stop pin mounted on the back support linkage and positioned to contact a portion of the headrest mounting linkage when in the closed position to prevent the headrest mounting linkage from moving beyond the closed position. A second stop pin may also be provided that is mounted on the back support linkage and positioned to contact a portion of the headrest mounting linkage when in the support position to prevent the headrest mounting linkage from moving beyond the support position.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWINGS

In the accompanying drawings which form a part of the specification and are to be read in conjunction therewith and in which like reference numerals are employed to indicate like parts in the various views.

DETAILED DESCRIPTION OF THE INVENTION

Figure 1:
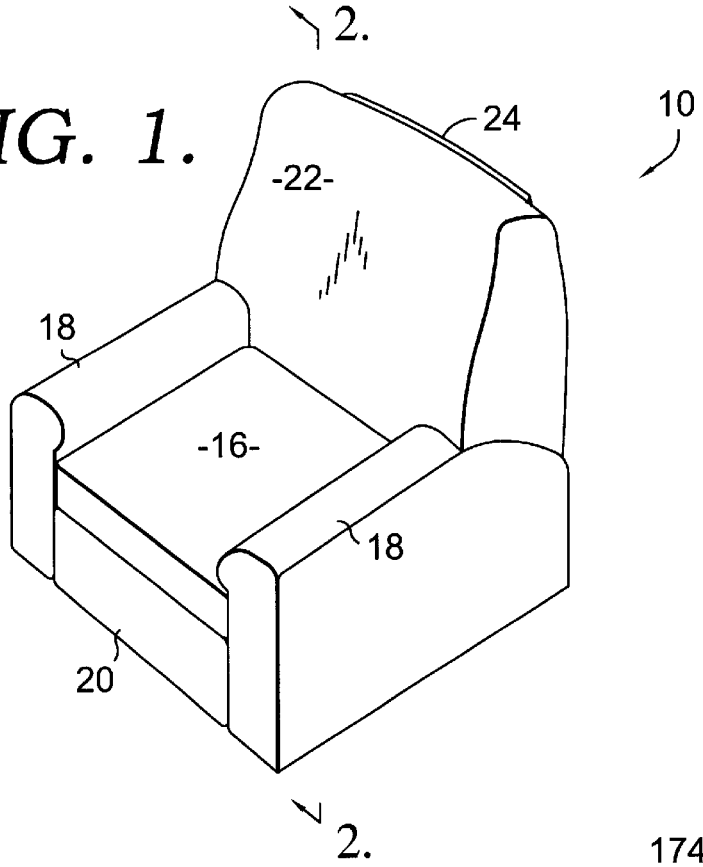
FIG. 1 is a front perspective view of a rocker recliner chair in an upright position having a headrest in the closed position according to the present invention.
Figure 2:
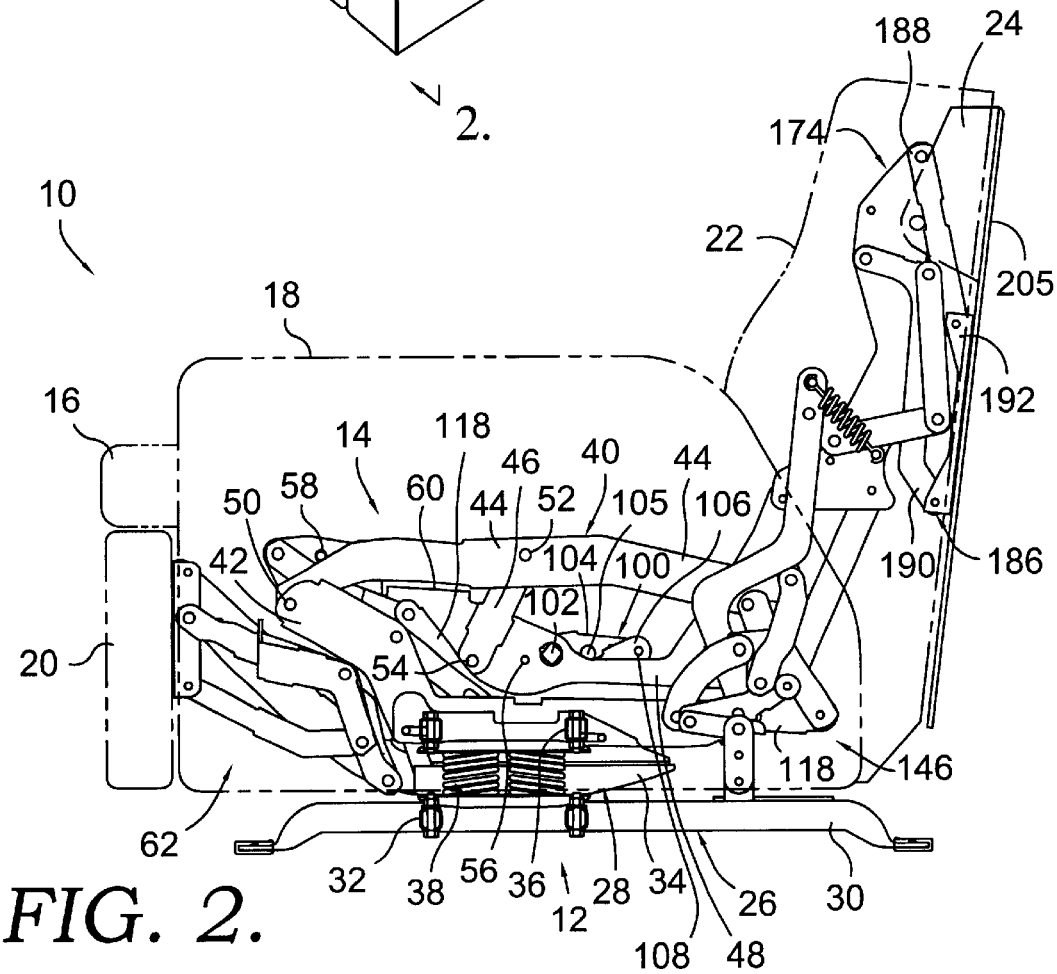
FIG. 2 is a cross-sectional view taken along line 2—2 of FIG. 1 showing the chair in an upright position with a seat, backrest, footrest, side and headrest of the chair in broken lines and a headrest mounting linkage in a closed position.
Figure 3:
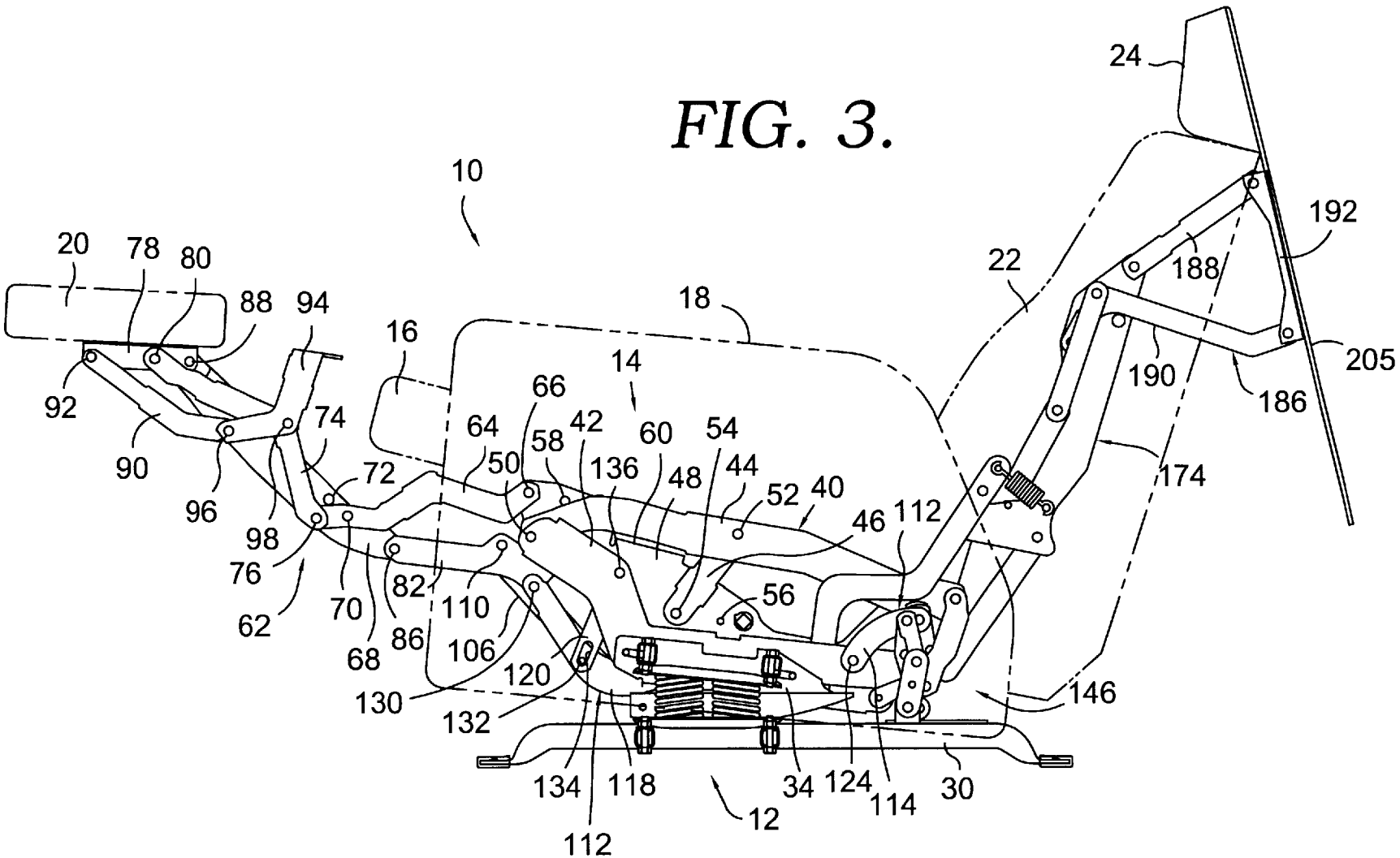
FIG. 3 is view similar to FIG. 2 showing the chair in an intermediate position with the headrest mounting linkage in a support position.
Figure 4:
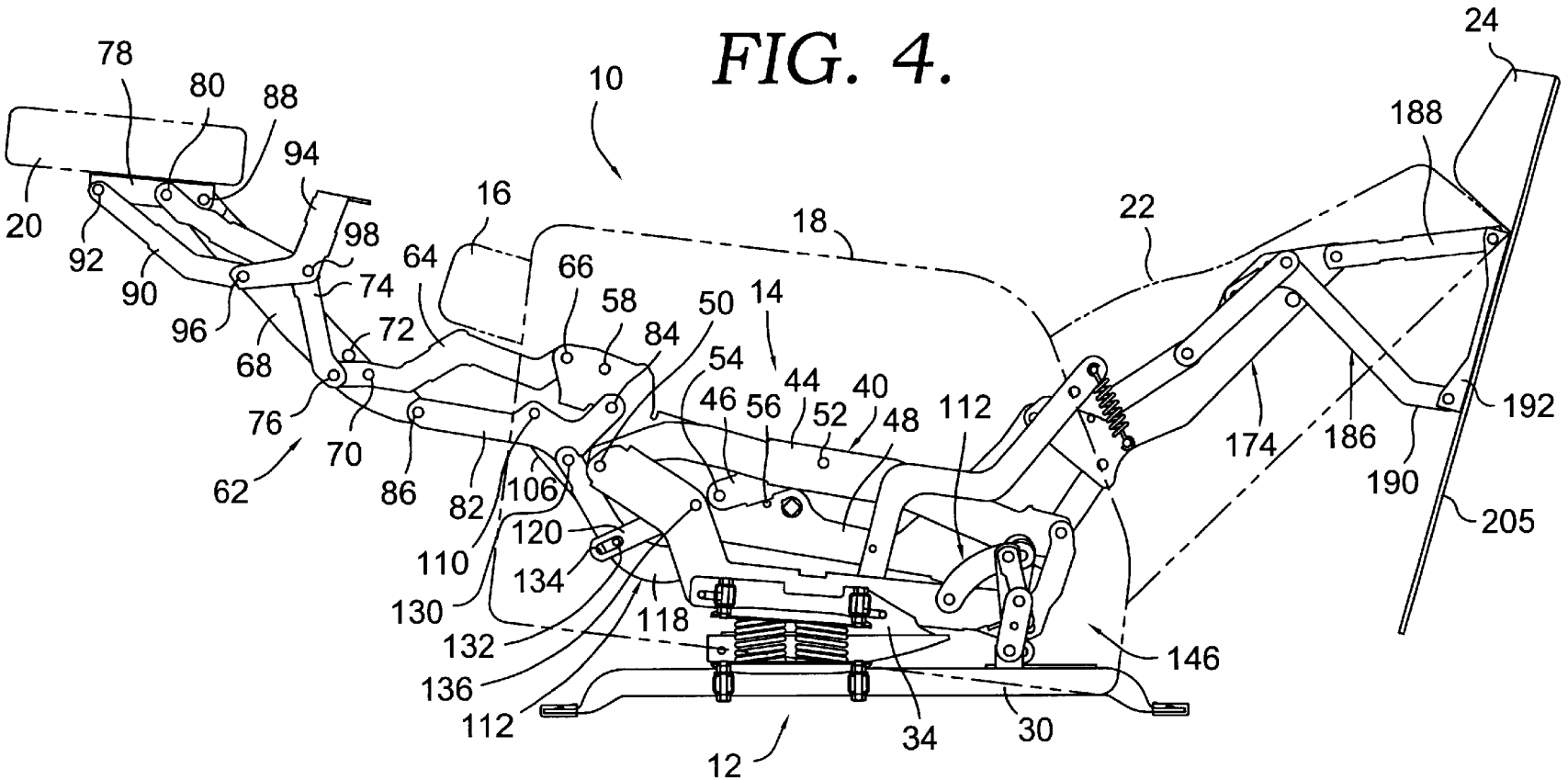
FIG. 4 is a view similar to FIG. 2 showing the chair in a fully reclined position with the headrest mounting linkage maintaining the support position.

Referring now to the drawings in detail, and initially to FIG. 1, numeral 10 generally designates a rocker recliner chair constructed in accordance with a first preferred embodiment of the present invention. Generally, as best seen in FIGS. 1 and 2, the chair 10 includes a support frame 12 that provides support for a pair of linkage mechanisms 14 positioned on opposite sides of the chair 10. Linkage mechanisms 14 mount a seat 16, a pair of upstanding opposed armrests 18, a footrest 20 and a backrest 22 to frame 12 for movement between an upright position as best seen in FIG. 2, an intermediate position as best seen in FIG. 3 and a fully reclined position as best seen in FIG. 4. Linkage mechanisms 14 also operate to move a headrest 24 between a closed position and a support position when chair 10 is moved from the upright position to an intermediate position. Furthermore, linkage mechanisms 14 maintain the position of headrest 24 relative to backrest 22 when chair 10 moves from the intermediate position to the fully reclined position.

As best seen in FIG. 2, support frame 12 includes a base 26 and a rocker cam assembly 28. Base 26 includes a pair of side rails 30 positioned on opposite sides of chair 10 and extending between front and rear portions of chair 10. A pair of cross rails 32 interconnect the rails 30 and extend between the sides of chair 10. Rocker cam assembly 28 includes a pair of rocker cams 34 that rest on opposite sides of base 26 and allow for forward and rearward rocking of chair 10 when in an upright position. A pair of cross pieces 36 are coupled to each rocker cam 34 and are mounted to cross rails 32 by a set of springs 38.

Seat 16 is mounted to support frame 12 on opposite sides of chair 10 by a pair of linkage mechanisms 14. Specifically, as best seen in FIGS. 2–4, each linkage mechanism 14 comprises a seat mounting linkage 40 that mounts seat 16 to rocker cams 34. Seat mounting linkage 40 includes a cam link 42, a carrier link 44, a front recline control link 46 and a support link 48. Cam link 42 is fixedly mounted to rocker cams 34 and extends towards the front portion of chair 10. Carrier link 44 is pivotally coupled to cam link 42 at a rivet 50 and extends toward the rear portion of chair 10. Further, an intermediate portion of carrier link 44 is pivotally coupled to an end portion of front recline control link 46 at rivet 52. The opposite end portion of front recline control link 46 is pivotally coupled to an intermediate portion of support link 48 at rivet 54. A stop pin 56 extends outwardly from support link 48 and is positioned to contact front recline control link 46 when chair 10 is in the fully reclined position. Support link 48 has an additional stop pin 58 that is positioned to contact a top edge of carrier link 44 as chair 10 is moving between the upright and intermediate positions. Support link 48 further includes a seat mounting plate 60 that provides a surface for seat 16 to rest on so that seat 16 may be coupled to support link 48.

The footrest 20 is connected to seat mounting linkage 40 by a footrest extension linkage 62. It will be understood and appreciated that footrest extension linkage 62 is a conventional lazy tong linkage that is adapted to place the footrest in a retracted position as best seen in FIG. 2, an extended position as best seen in FIG. 3. Footrest extension linkage 62 remains in the extended position as chair 10 moves to the fully reclined position as best seen in FIG. 4. As best seen in FIGS. 3 and 4, footrest extension linkage 62 includes an upper link 64 that is pivotally coupled to a front portion of support link at rivet 66. An intermediate portion of upper link 64 is pivotally coupled with an intermediate portion of a top footrest mounting link 68 at rivet 70. Top footrest mounting link 68 has a stop pin 72 extending therefrom that is positioned to contact a top portion of upper link 64 when footrest 20 is in the extended position. Upper link 64 is also pivotally coupled to an intermediate link 74 at rivet 76. A distal end of intermediate link 74 is pivotally coupled to a middle portion of a footrest mounting plate 78 at rivet 80.

As best seen in FIG. 4, footrest extension linkage 62 further includes a lower link 82 that is pivotally coupled with a front portion of support link 48 at rivet 84 and is pivotally coupled with top footrest mounting link 68 at rivet 86. Top footrest mounting link is 68 is also pivotally coupled to a top portion of footrest mounting bracket 78 at rivet 88. A bottom footrest mounting link 90 is pivotally coupled with a bottom portion of footrest mounting bracket 78 at rivet 92 and also pivotally coupled with a link 94 at rivet 96. Link 94 is further coupled to a middle portion of intermediate link 74 at rivet 98. Footrest mounting bracket 78 is adapted to have footrest 20 mounted thereto.

Footrest extension linkage 62 may be selectively released to the extended position by a handle actuating mechanism 100 as best seen in FIG. 2. Handle actuating mechanism 100 includes a handle, not shown, a shaft 102, a connecting link 104 and a trigger link 106. As best seen in FIG. 2, shaft 102 is pivotally mounted between support links 48 on each linkage mechanism 14. The handle, not shown, is typically positioned on one side of chair 10 and is fixedly mounted to shaft 102. Connecting link 104 is also fixedly mounted to shaft 102 and is pivotally coupled to trigger link 106 at rivet 108. Connecting link 104 has a stop pin 105 extending therefrom that is positioned to contact trigger link 106 when handle actuating mechanism 100 retains footrest extension linkage 62 in the retracted position as shown in FIG. 2. As best seen in FIGS. 2 and 3, trigger link 106 is further pivotally coupled to an intermediate portion of lower link 82 by rivet 110. The handle may be used to rotate shaft 102 and connecting link 104 relative to support link 48 so that trigger link 106 can be released to allow footrest extension linkage 62 to move to the extended position. The handle actuating mechanism further includes a spring, not shown, that interconnects an intermediate portion of connecting link 104 to a front portion of support link 48. The spring is adapted to bias footrest extension linkage 62 to the extended position once handle actuating mechanism is released which will be discussed in more detail below.

Figure 5:
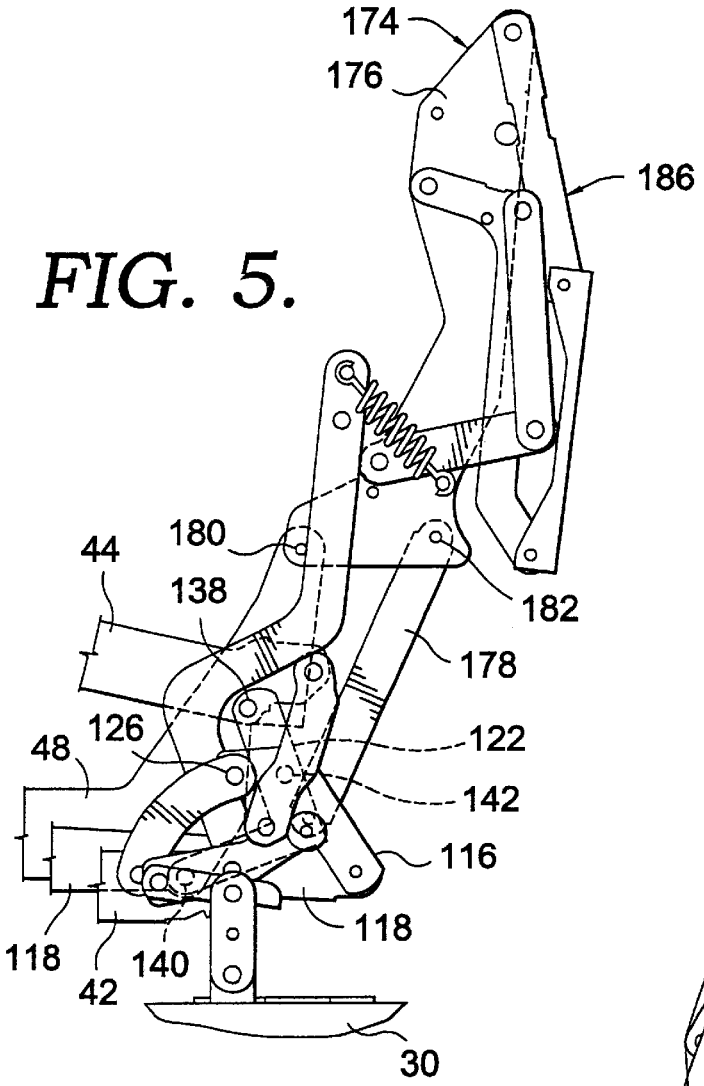
FIG. 5 is an enlarged fragmentary side elevational view of a linkage mechanism in the upright position with a rocker cam assembly being removed and portions shown in hidden lines to show a back support linkage being coupled to a seat mounting linkage and a drive linkage.
Figure 6:
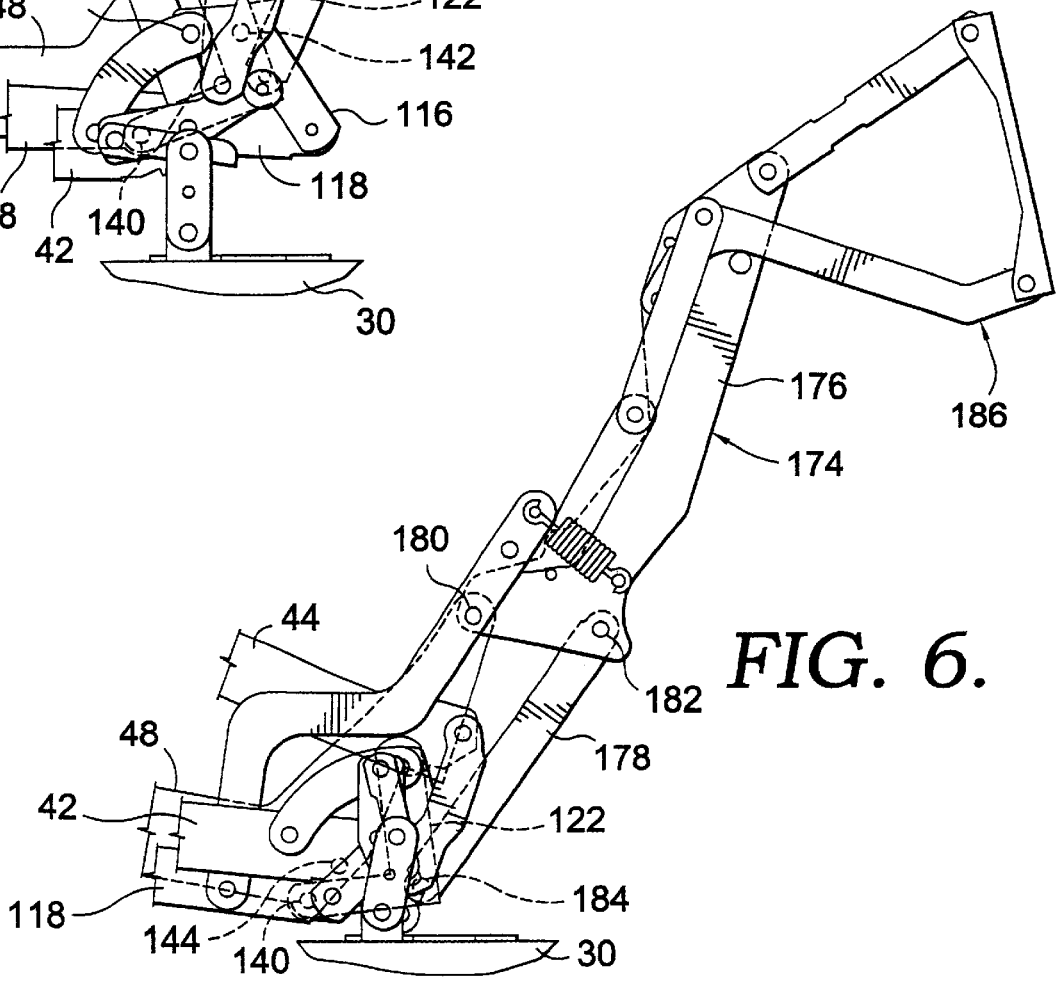
FIG. 6 is an enlarged fragmentary side elevational view similar to FIG. 5 showing the position of the back support linkage and portions of the seat mounting linkage and drive linkage when the chair is in the intermediate position.
Figure 7:
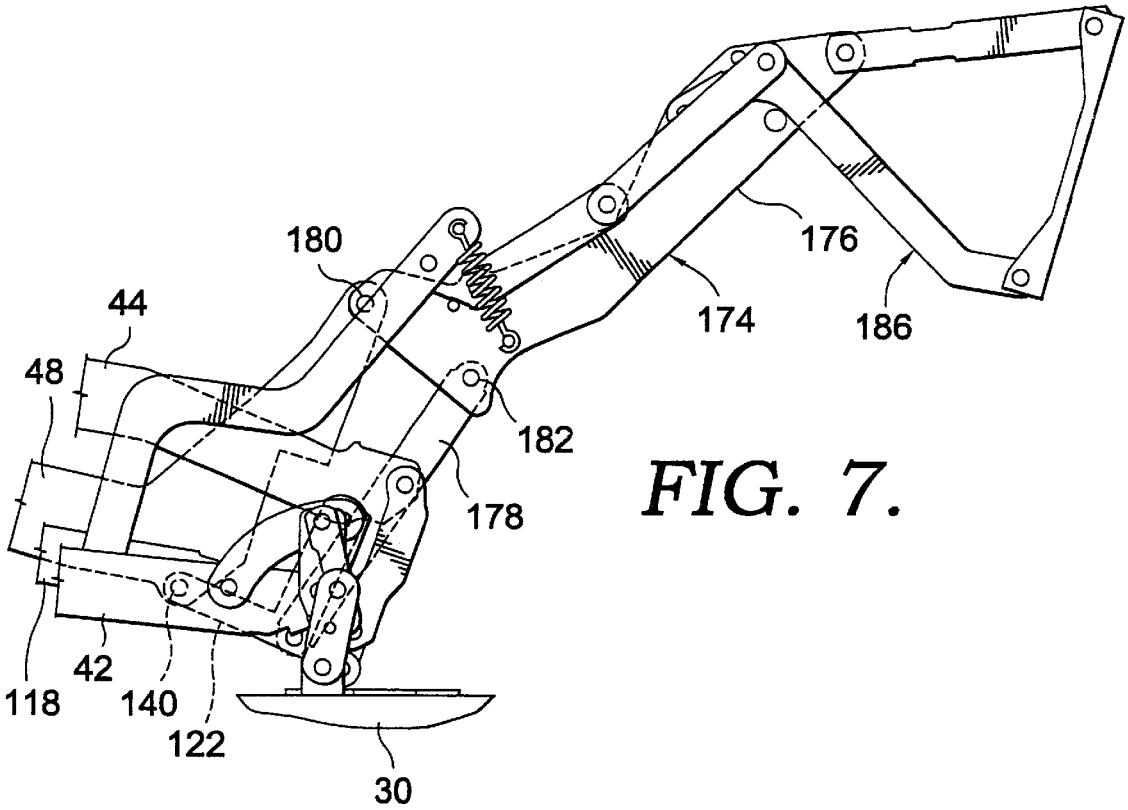
FIG. 7 is an enlarged fragmentary side elevational view similar to FIG. 5 showing the position of the back support linkage when the chair is in the fully reclined position.
Figure 8:
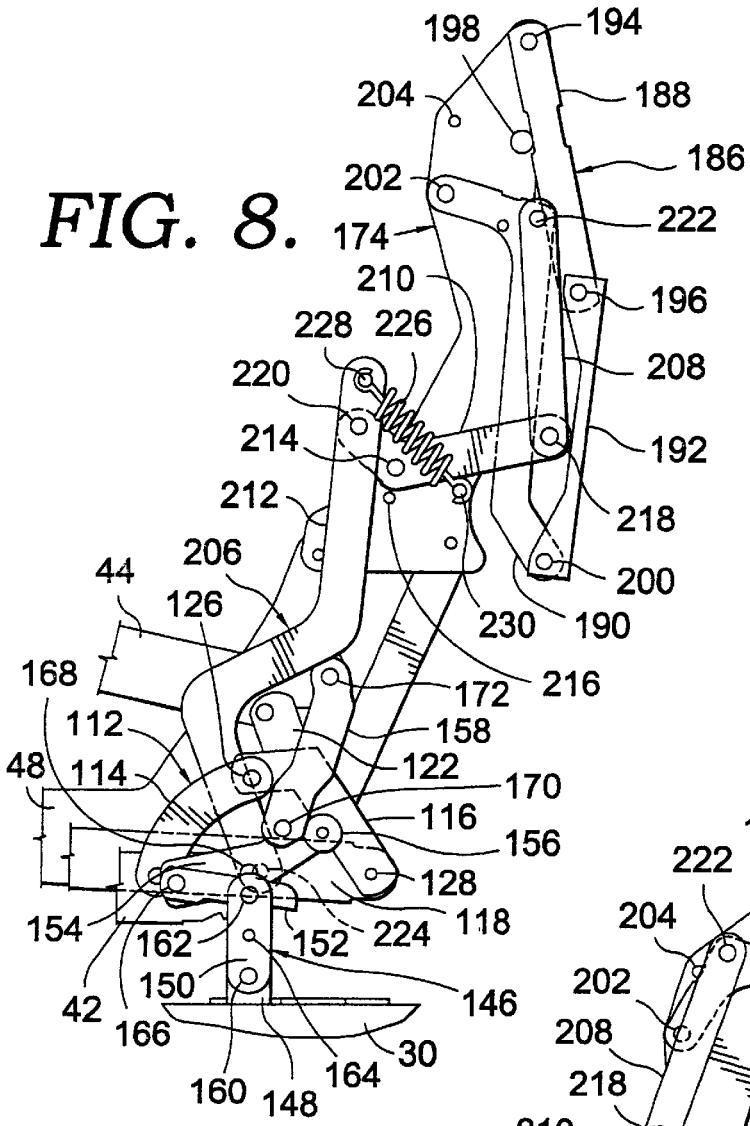
FIG. 8 is an enlarged fragmentary side elevational view of the linkage mechanism in the upright position with a rocker cam assembly being removed and portions shown in hidden lines to show the headrest mounting linkage coupled to the back support linkage and a pop-up linkage, and also showing the pop-up linkage being coupled to the drive linkage.
Figure 9:
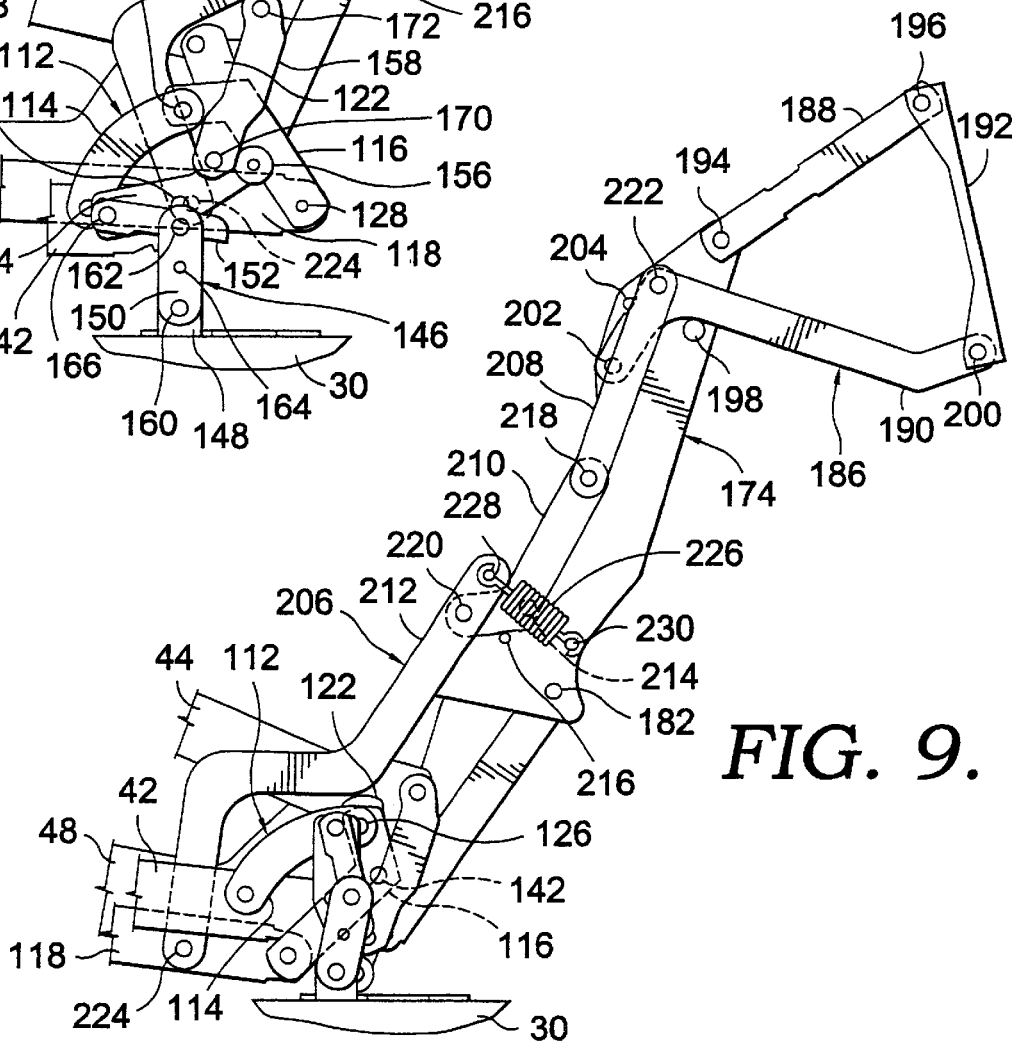
FIG. 9 is an enlarged fragmentary side elevational view similar to FIG. 8 showing the position of the headrest mounting linkage, pop-up linkage and a portion of the drive linkage when the chair is in the intermediate position.
Figure 10:
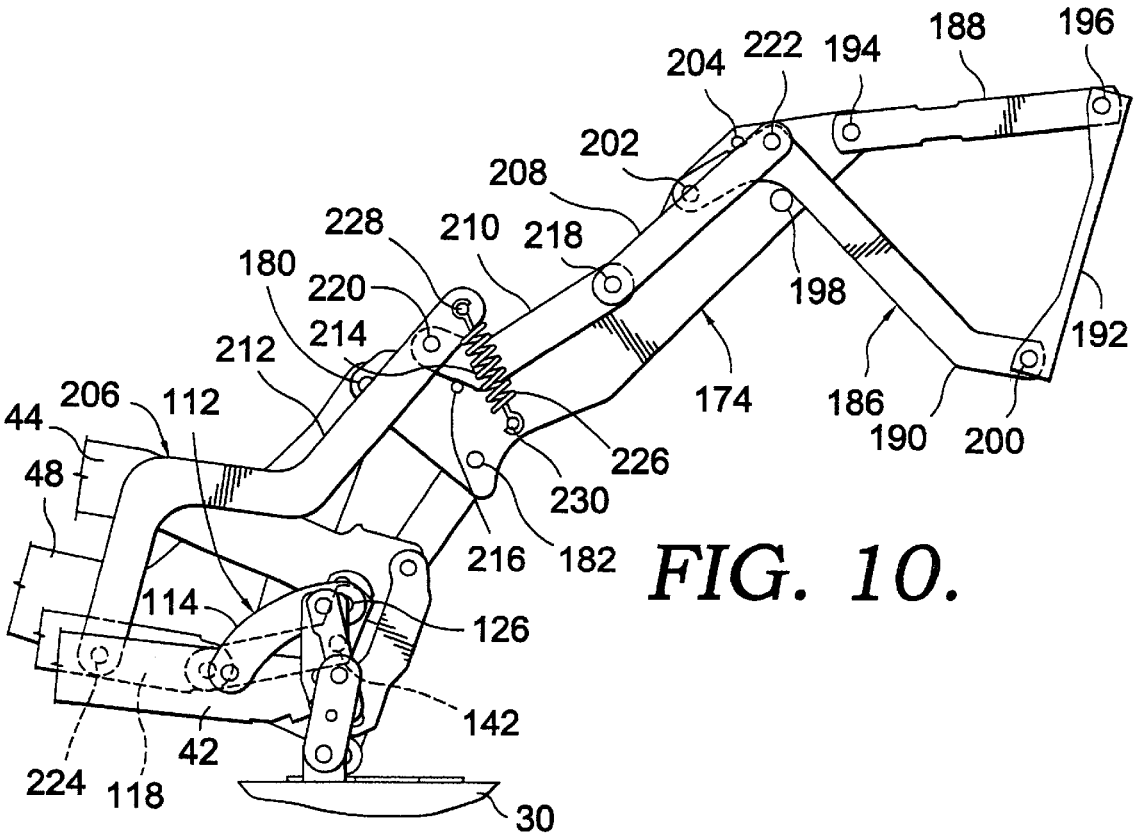
FIG. 10 is an enlarged fragmentary side elevational view similar to FIG. 8 showing the position of the headrest mounting linkage, pop-up linkage and a portion of the drive linkage when the chair is in the fully reclined position.

Each linkage mechanism 14 includes a drive linkage 112 that couples a rear portion of seat mounting linkage 40 to footrest extension linkage 62. As best seen in FIGS. 3 and 8, drive linkage 112 includes a rear control link 114, a seat bell crank 116, an ottoman drive link 118, a front control link 120 and a backrest bell crank 122. Rear control link 114 is pivotally coupled with cam link 42 at rivet 124 and pivotally coupled with seat bell crank 116 at rivet 126. Seat bell crank 116 is also pivotally coupled with ottoman drive link 118 at rivet 128. As best seen in FIGS. 3 and 4, ottoman drive link 118 extends from the rear portion of chair 10 and is coupled to footrest mounting linkage 62. Specifically, ottoman drive link 118 is pivotally coupled to an intermediate portion of lower link 82 at rivet 130. Ottoman drive link 118 further includes a rivet 132 positioned on an intermediate portion thereof that is adapted to slide within a slot 134 formed in one end of front control link 120. The opposite end of front control link 120 is pivotally coupled with cam link 42 at rivet 136. As best seen in FIGS. 5–7, backrest bell crank 122 is pivotally coupled to a rear portion of carrier link 44 at rivet 138. Backrest bell crank 122 is also pivotally coupled to support link 48 at rivet 140. As best seen in FIGS. 5, 9 and 10, an intermediate portion of backrest bell crank 122 is pivotally coupled with an intermediate portion of seat bell crank 116 at rivet 142. Referring to FIG. 6, a stop pin 144 extends from support link 48 and is positioned to contact backrest bell crank 122 when chair 10 is in the intermediate position.

Turning to FIG. 8, linkage mechanisms 14 further include a rock blocker linkage 146 that prevents chair 10 from rocking relative to support frame 12 when chair 10 is in the intermediate position or fully reclined position. As best seen in FIG. 8, rock blocker linkage 146 is generally situated at the rear portion of chair 10 and includes a base link 148, an anchor link 150, a connector link 152, a roller link 154, a roller 156 and a securing link 158. Base link 148 is fixedly mounted to side rails 30 by a fastener, weldment or the like. One end of anchor link 150 is pivotally coupled to base link 148 by rivet 160 and the opposite end is pivotally coupled to connector link 152 by rivet 162. Anchor link 150 has a stop pin 164 mounted thereto that is positioned to contact connector link 152 when chair 10 is in the intermediate and fully reclined positions. Connector link 152 is also pivotally coupled to roller link 154 by rivet 166. An intermediate portion of roller link 154 is pivotally coupled to a rear portion of cam link 42 at rivet 168 and roller 156 is rotatably mounted to the distal end of roller link 154 and is adapted to contact the flat portion of base link 148 when chair 10 is in the intermediate or fully reclined positions. One end of securing link 158 is pivotally mounted to an intermediate portion of roller link 154 by rivet 170, and the opposite end of link 158 is pivotally coupled to the rear portion of carrier link 44.

As best seen in FIG. 2, backrest 22 is carried on each linkage mechanism 14 by a back support linkage 174. With additional reference to FIGS. 3 and 4, back support linkage 174 is adapted to recline backrest 22 as chair 10 moves from the upright to the fully reclined position. As best seen in FIG. 5, back support linkage 174 includes a mounting post 176 and a backrest support link 178. A lower portion of mounting post 176 is pivotally mounted to support link 48 by rivet 180 and to backrest support link 178 by rivet 182. Backrest support link 178 extends downwardly from mounting post 176 and is pivotally coupled with an intermediate portion of backrest bell crank 122 by rivet 184 (FIG. 6).

As best seen in FIGS. 2–4, headrest 24 is pivotally mounted to back support linkage 174 by a headrest mounting linkage 186. As best seen in FIGS. 8–10, headrest mounting linkage 186 includes an upper mounting link 188, a lower mounting link 190 and a mounting plate 192. One end of upper mounting link 188 is pivotally coupled to a top portion of mounting post 176 by rivet 194 and the opposite end is pivotally coupled to mounting plate 192 by rivet 196. A first stop pin 198 extends from mounting post 176 and is positioned to contact the lower edge of upper mounting link 188 when headrest mounting linkage 186 is in the closed position as seen in FIG. 8. First stop pin 198 is adapted to prevent headrest mounting linkage 186 from moving beyond the closed position. Mounting plate 192 is further pivotally coupled to an end portion of lower mounting link 190 by rivet 200. The opposite end of lower mounting link 190 is in turn pivotally coupled to mounting post 176 by rivet 202. A second stop pin 204 extends from mounting post 176 and is positioned to contact an upper edge of lower mounting link 190 when headrest mounting linkage 186 is in the support position. Second stop pin 204 is adapted to prevent headrest mounting linkage 186 from moving beyond the support position.

As best seen in FIGS. 2–4, headrest 24 is interconnected with headrest mounting linkage 186 by a headrest support 205. Specifically, headrest support 205 is mounted to mounting plates 192 on each linkage mechanism 14 positioned on opposite sides of the chair through the use of mechanical fasteners, welding, adhesive or the like. In addition, headrest support 205 may be of a sufficient size to form the rear wall of chair 10. Headrest 24 is coupled with a top portion of headrest support 205 and is recessed within backrest 22 when chair 10 is in the upright position as best seen in FIG. 2. Furthermore, headrest 24 may be moved adjacent to the top edge of backrest 22 when chair 10 is moved to the intermediate and fully reclined positions as best seen in FIGS. 3 and 4.

Each linkage mechanism 14 further provides for a pop-up linkage 206 that couples drive linkage 112 to headrest mounting linkage 186. As best seen in FIG. 8, pop-up linkage 206 includes a toggle link 208, a headrest bell crank 210 and a headrest drive link 212. An intermediate portion of headrest bell crank 210 is pivotally coupled to mounting post 176 at rivet 214. With additional reference to FIGS. 9 and 10, a third stop pin 216 extends from mounting post 176 and is positioned to contact headrest bell crank 210 when headrest is in the support position. Further, third stop in 216 is adapted to maintain the position of headrest bell crank 210 relative to back support linkage 174 when chair 10 moves between the intermediate and fully reclined positions. One end of headrest bell crank 210 is pivotally coupled to toggle link 208 by rivet 218 and the opposite end is pivotally coupled to headrest drive link 212 by rivet 220. Rivet 214 is positioned rearwardly and below rivet 220 when headrest mounting linkage 186 is in the closed position. Toggle link 208 is pivotally coupled to an intermediate portion of lower mounting link 190 by rivet 222. Further, headrest drive link 212 is pivotally coupled to ottoman drive link 118 by rivet 224.

In another embodiment, pop-up linkage 206 may further include a spring 226 that couples headrest drive link 212 to mounting post 176. Specifically, a pair of holding pins 228, 230 each having an aperture, not shown, formed therein extend from headrest drive link 212 and mounting post 176 respectively. The hooks positioned on both ends of spring 226 are placed through the apertures thereby coupling spring 226 to pins 228, 230.

While the above description has focused on a linkage that is used with a rocker recliner chair, it will be understood and appreciated by one skilled in the art that the novel linkage mechanism with the pop-up linkage can also be used on a lift chair.

In operation, rocker recliner chair 10 may be moved between the upright position as best seen in FIG. 2, the intermediate position as best seen in FIG. 3 and the fully reclined position as best seen in FIG. 4. As best seen in FIGS. 2 and 3, to move chair 10 from the upright position to the intermediate position, the handle, not shown is rotated clockwise (as viewed in FIGS. 2–4) toward the rear portion of chair 10, which in turn rotates shaft 102 and connecting link 104 in a clockwise direction relative to support link 48. The rotation of connecting link 104 causes trigger link 106 to move toward the front of chair 10 thereby allowing footrest extension linkage 62 to be released to the extended position. The spring, not shown, interconnecting connecting link 104 and support link 48 operates to bias footrest extension linkage 62 to the extended position.

In addition, drive linkage 112 also operates to move footrest extension linkage 62 to the extended position. Once handle actuating mechanism 100 releases footrest extension linkage 62 allowing footrest 20 to move to the extended position, the rear control link 114, seat bell crank 116, front control link 120 and backrest bell crank 122 move in response to the weight of a chair occupant and to drive ottoman drive link 118 generally downwardly and toward the front of chair 10. This translation of ottoman drive link 118, along with the bias of the spring, causes footrest extension linkage 62 to move to the extended position.

As best seen in FIGS. 8 and 9, as ottoman drive link 118 generally moves downwardly and toward the front of chair 10 to extend footrest 20, link 118 also operates to move the bottom portion of headrest drive link 212 generally downwardly and toward the front of chair 10 due to the pivotal connection at rivet 224. The downward and forward movement of the bottom portion of headrest drive link 212 causes the top portion of link 212 to rotate headrest bell crank 210 counterclockwise about rivet 214. If spring 226 is utilized, it operates to bias the top portion of headrest drive link 212 toward holding pin 230 thereby assisting headrest drive link 212 to rotate headrest bell crank 210 counterclockwise about rivet 214. The counterclockwise rotation of headrest bell crank 210 about rivet 214 causes bell crank 210 to move toggle link 208 generally upwardly and towards the front of chair 10. The upward and forward movement of toggle link 208 causes lower mounting link 190 to rotate counterclockwise about rivet 202. Lower mounting link 190 in turn rotates upper mounting link 188 and mounting plate 192 counterclockwise about rivet 194. Pop-up linkage 206 will continue to rotate headrest mounting linkage 186 until the top edge of lower mounting link 190 is placed in contact with second stop pin 204. Once headrest mounting linkage 186 is stopped by second pin 204, headrest 24 is placed adjacent to the top portion of backrest 22 in the support position. Second pin 204 operates to prevent headrest mounting linkage 186 from moving beyond the support position. A user may then use headrest 24 to support his or her head when utilizing chair 10 in the intermediate position.

Once headrest mounting linkage 186 is in the support position, rock blocker linkage 146 operates to prevent chair 10 from rocking relative to support frame 12. Specifically, once drive linkage 112 moves footrest extension linkage 62 to the extended position, and pop-up linkage 206 moves headrest mounting linkage 186 to the support position, roller 156 is placed in contact with the flat portion of base link 148. The contact between roller 156 and base link 148 prevents chair from rocking relative to support frame 12 when footrest 20 is extended and headrest 24 is in the support position.

Chair 10 may also be moved from the intermediate position shown in FIG. 3 to the fully reclined position in FIG. 4. To move chair 10 to the fully reclined position, a user may apply a rearward force against backrest 22 to recline backrest 22. As best seen in FIGS. 5–7, backrest 22 is reclined and backrest support link 178 moves downwardly and forwardly to rotate backrest bell crank 122 clockwise about rivet 138. The clockwise rotation of backrest bell crank 122 moves support link 48 towards the front portion of chair 10. As stated above and as best seen in FIGS. 5, 9 and 10, backrest bell crank 122 and seat bell crank 116 are pivotally coupled by rivet 142. The clockwise rotation of backrest bell crank 122 causes seat bell crank 116 to rotate in a clockwise direction about rivet 126 thereby moving ottoman drive link 118 upward and toward the front portion of the chair along with support link 48. Footrest extension linkage 62 maintains its extended position relative to seat mounting linkage 40 as the ottoman drive link 118 and support link 48 are shifted toward the front of chair 10. Furthermore, as support link 48 and ottoman drive link 118 are shifted upwardly and towards the front portion of chair 10, roller 156 rolls along and remains in contact with base link 148 to continue to prevent chair 10 from rocking relative to support frame 12 when in the fully reclined position.

As best seen in FIGS. 9 and 10, when chair 10 moves from the intermediate position to the fully reclined position, headrest drive link 212 moves upwards and towards the front portion of chair 10 along with support link 48 due to their pivotal connection by rivet 224. Since headrest drive link 212 is moving upwards and toward the front portion of chair 10, link 212 does not operate to rotate headrest drive crank 210 about rivet 214. Therefore, the headrest bell crank 210 and toggle link 208 maintain the position of headrest mounting linkage 186 relative to back support linkage 174.

In addition, headrest bell crank 210 and toggle link 208 also maintain their positions relative to back support linkage 174 when chair 10 moves from the intermediate position to the fully reclined position due to the contact between headrest bell crank 210 and third stop pin 216. Once headrest mounting link 186 is in the support position, third stop pin 216 prevents headrest bell crank 210 from any further counterclockwise rotation about rivet 214. Moreover, second stop pin 204 is placed in contact with the upper edge of lower mounting link 190 to prevent any further counterclockwise rotation of headrest mounting link 186 relative to back support linkage 174. Since lower mounting link 190 and headrest bell crank 210 are generally stationary relative to back support linkage 174 as the chair 10 is moved from the intermediate to fully reclined position, toggle link 208 will maintain the position of headrest mounting linkage 186 relative to back support linkage 174. Thus, headrest 24 will remain in constant orientation relative to the backrest 22 and provide head support as chair 10 is moved from the intermediate position to the fully reclined position.

Further, if spring 226 is utilized, it operates to bias back support linkage 174 toward the intermediate position as best seen in FIG. 9. Specifically, holding pins 228, 230 are moved further apart as chair 10 is moved from the intermediate position to the fully reclined position. This change in position stretches spring 226 along its longitudinal axis thereby biasing mounting post 176 to rotate counterclockwise about rivet 180 to place chair 10 in the intermediate position.

To move chair 10 from the fully reclined position to the intermediate position, a user may apply force to move the backrest 22 toward the front of the chair. This may be accomplished by sitting upright in chair 10. Similar to the movement of chair 10 from the intermediate position to the fully reclined position, pop-up linkage 206 operates to maintain the position of headrest mounting linkage 186 relative to back support linkage 174 when chair 10 is moved from the fully reclined position to the intermediate position.

As best seen in FIGS. 5–7, backrest support link 178 moves upward and rearwardly to rotate backrest bell crank 122 counterclockwise about rivet 138 as backrest 22 is being moved to the upright position. The counterclockwise rotation of backrest bell crank 122 moves support link 48 towards the rear of chair 10. As best seen in FIGS. 5, 9 and 10, backrest bell crank 122 and seat bell crank 116 are pivotally coupled by rivet 142. Therefore, the counterclockwise rotation of backrest bell crank 122 causes seat bell crank 116 to rotate in a counterclockwise direction about rivet 126 thereby moving ottoman drive link 118 downward and toward the rear of chair 10 along with support link 48. Footrest extension linkage 62 remains in the extended position relative to seat mounting linkage 40 as the ottoman drive link 118 and support link 48 are shifted downward and toward the rear of chair 10. Furthermore, as support link 22 and ottoman drive link 118 are shifted downwardly and towards the rear of chair 10, roller 156 rolls along and remains in contact with base link 148 to continue to prevent chair from rocking relative to support frame 12 when in the intermediate position.

As best seen in FIGS. 9 and 10, when chair 10 moves from the fully reclined position to the intermediate position, headrest drive link 212 moves downward and towards the rear of chair 10 along with support link 48 due to their pivotal connection by rivet 224. Third stop pin 216 prevents headrest drive crank 210 from rotating in a counterclockwise direction about rivet 214 even though headrest drive link 212 moves downward and towards the rear of chair 10 when chair 10 is moved from the fully reclined position to the intermediate position. Moreover, second stop pin 204 is placed in contact with the upper edge of lower mounting link 190 to prevent headrest mounting link 186 from rotating in a counterclockwise direction relative to back support linkage 174. Since lower mounting link 190 and headrest bell crank 210 are generally stationary relative to back support linkage 174 as the chair 10 is moved from the fully reclined position to the intermediate position, toggle link 208 will also maintain the position of headrest mounting linkage 186 relative to back support linkage 174. Thus, headrest 24 will maintain its orientation relative to the backrest 22 and provide head support as chair 10 is moved from the fully reclined position to the intermediate position. Further, if spring 226 is utilized, it operates to bias back support linkage 174 toward the intermediate position.

To move chair 10 from the intermediate position to the upright position, a user applies a downward force on footrest extension linkage 62 to place footrest 20 in the retracted position. In addition, the handle, not shown, may be rotated in a counterclockwise direction toward the front portion of chair 10 to assist in retracting footrest extension linkage 62. In particular, the counterclockwise rotation of the handle causes shaft 102 and connecting link 104 to rotate in a counterclockwise direction relative to support link 48. The rotation of connecting link 104 causes trigger link 106 to move toward the rear of chair 10 thereby releasably retaining footrest extension linkage 62 in the retracted position. The spring, not shown, interconnecting connecting link 104 and support link 48 is stretched as shaft is rotated in the counterclockwise direction. The spring operates to retain handle actuating mechanism 100 in the retracted position once trigger link 106 is placed in contact with stop pin 105.

As chair 10 moves to the upright position, footrest extension linkage 62 moves ottoman drive link 118 upwardly and toward the rear of chair 10. Specifically, as best seen in FIGS. 8 and 9, the upward and rearward movement of ottoman drive link 118 moves the bottom portion of headrest drive link 212 generally upward and toward the rear of chair 10 due to the pivotal connection at rivet 224. The upward and rearward movement of the bottom portion of headrest drive link 212 causes the top portion of link 212 to rotate headrest bell crank 210 clockwise about rivet 214. If spring 226 is utilized, it is stretched along its longitudinal axis to create a bias to resist the upward movement of the upper portion of headrest drive link 212. The clockwise rotation of headrest bell crank 210 about rivet 214 causes bell crank 210 to pull toggle link 208 generally downwardly and towards the rear of chair 10. The downward and rearward movement of toggle link 208 operates to rotate lower mounting link 190 clockwise about rivet 202. Lower mounting link 190 in turn rotates upper mounting link 188 and mounting plate 192 clockwise about rivet 194. Pop-up linkage 206 will continue to rotate headrest mounting linkage until the lower edge of upper mounting link 188 is placed in contact with first stop pin 198. Headrest 24 is in the closed position and recessed within backrest 22 once headrest mounting linkage 186 is stopped by first stop pin 198. First stop pin 198 is used to prevent headrest mounting linkage 186 from moving beyond the closed position.

Once headrest mounting linkage 186 is in a closed position, rock blocker linkage 146 is positioned in such a way that does not prevent chair 10 from rocking relative to support frame 12. Specifically, roller 156 is no longer in contact with the flat portion of base link 148. Therefore, chair 10 is free to rock relative to support frame 12 through the use of rocker cam assembly 28 when footrest 20 is retracted and headrest is in the closed position.

It can, therefore, be seen that the invention is one that is designed to overcome the drawbacks and deficiencies existing in the prior art. The invention provides a pop-up linkage for a rocker-recliner chair that moves a headrest between a closed position and a support position as the chair moves between the upright, intermediate and fully reclined positions. The pop-up linkage also maintains the position of the headrest relative to the backrest when the chair is moved from the intermediate position to the fully reclined position.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

What is claimed is:

1. A linkage mechanism for a rocker-recliner chair having a base, a seat, a footrest, a backrest and a headrest, said linkage mechanism comprising:

a rocker cam assembly mounted on the base;

a seat mounting linkage coupling the seat to the rocker cam assembly;

a footrest extension linkage coupled with the seat mounting linkage and having the footrest mounted thereto;

a drive linkage coupling said seat mounting linkage with said footrest extension linkage, said drive linkage adapted to drive said footrest extension linkage from a retracted position to an extended position;

a back support linkage coupled with said seat mounting linkage and having the backrest mounted thereto;

a headrest mounting linkage coupled with said back support linkage and having the headrest coupled thereto;

a pop-up linkage including a headrest drive link, a headrest bell crank and a toggle link, said headrest bell crank coupling said headrest drive link to said toggle link and being pivotally coupled with said back support linkage, said headrest drive link being coupled with said drive linkage, and said toggle link being coupled with said headrest mounting linkage; and a rock blocker linkage coupled with said seat mounting linkage and the base, wherein a portion of said rock blocker linkage is selectively coupled with said base to prevent the chair from rocking relative to the base when said footrest extension linkage is in the extended position, wherein said headrest drive linkage, said headrest bell crank and said toggle link cooperate to move said headrest mounting linkage to a support position when said drive linkage moves said footrest extension linkage to the extended position, and wherein said headrest drive linkage, said headrest bell crank and said toggle link cooperate to move said headrest mounting linkage to a closed position when said footrest extension linkage is moved to the retracted position.

2. The linkage mechanism as recited in claim 1, further comprising a spring coupled between said headrest drive link and said back support linkage for biasing said pop-up linkage toward the support position.

3. The linkage mechanism as recited in claim 1, wherein said headrest mounting linkage includes a first mounting link, a second mounting link and a mounting plate, wherein said mounting plate is coupled with said first and second mounting links, and wherein said first and second mounting links are coupled with said back support linkage.

4. The linkage mechanism as recited in claim 3, wherein said toggle link is coupled with an intermediate portion of said second mounting link.

5. The linkage mechanism as recited in claim 1, wherein said headrest drive link includes an upper and lower portion, wherein said lower portion is coupled with said drive linkage and said upper portion is coupled with said headrest bell crank.

6. The linkage mechanism as recited in claim 1, wherein the pivotal connection between said back support linkage and said headrest bell crank is at an intermediate portion of said headrest bell crank.

7. The linkage mechanism as recited in claim 1, wherein said headrest drive link and said toggle link are coupled to opposites end portions of said headrest bell crank.

8. The linkage mechanism as recited in claim 1, further comprising a first stop pin mounted on said back support linkage and positioned to contact a portion of said headrest mounting linkage when in the closed position to prevent said headrest mounting linkage from moving beyond the closed position.

9. The linkage mechanism as recited in claim 8, further comprising a second stop pin mounted on said back support linkage and positioned to contact a portion of said headrest mounting linkage when in a support position to prevent said headrest mounting linkage from moving beyond the support position.

10. The linkage mechanism as recited in claim 9, further comprising a third stop pin mounted on said back support linkage and positioned to contact a portion of said headrest bell crank to maintain the position of said headrest bell crank relative to said back support linkage when the chair moves between an intermediate position and a fully reclined position.

11. The linkage mechanism as recited in claim 1, further comprising a handle actuating mechanism coupled with said seat mounting linkage and said footrest extension linkage, wherein said handle actuating mechanism is selectively positioned to prevent said seat mounting linkage from moving relative to the rocker cam assembly when said footrest extension linkage is in the retracted position.

12. The linkage mechanism as recited in claim 1, wherein said pop-up linkage is adapted to recess the headrest within the backrest when footrest extension linkage is in the retracted position.

13. A linkage mechanism for a rocker-recliner chair having a base, a seat, a footrest, a backrest and a headrest, said linkage mechanism comprising:

a rocker cam assembly mounted on the base;

a seat mounting linkage coupling the seat to the rocker cam assembly;

a footrest extension linkage coupled with the seat mounting linkage and adapted to have the footrest mounted thereto;

a drive linkage coupling said seat mounting linkage with said footrest extension linkage, said drive linkage adapted to drive said footrest extension linkage from a retracted position to an extended position;

a back support linkage coupled with said seat mounting linkage and adapted to have the backrest mounted thereto;

a headrest mounting linkage coupled with said back support linkage and adapted to have the headrest coupled thereto; and a pop-up linkage including a headrest drive link having upper and lower portions, a headrest bell crank having first and second end portions, and a toggle link, said lower portion of said headrest drive link being coupled with said drive linkage and said upper portion being coupled with said first end portion of said headrest bell crank, said toggle link being coupled with said second end portion of said headrest bell crank and said headrest mounting linkage, and an intermediate portion of said headrest bell crank being pivotally coupled with said back support linkage, wherein said lower portion of said headrest drive link moves forwardly as said drive linkage drives said footrest extension linkage to the extended position whereby said upper portion of said headrest drive link rotates said headrest bell crank in a counterclockwise direction relative to said back support linkage as said drive linkage drives said footrest extension linkage to the extended position thereby rotating said headrest mounting linkage in a counterclockwise direction relative to said back support linkage to place said headrest mounting linkage in a support position, and wherein said lower portion of said headrest drive link moves rearwardly as said footrest extension linkage is moved to a retracted position whereby said upper portion of said headrest drive link rotates said headrest bell crank in a clockwise direction relative to said back support linkage when said footrest extension mechanism is moved to a retracted position thereby rotating said headrest mounting linkage in a clockwise direction relative to said back support linkage to place said headrest mounting linkage in a closed position.

14. The linkage mechanism as recited in claim 13, further comprising a spring coupled with said back support linkage and said upper portion of said headrest drive link for biasing said pop-up linkage toward the support position.

15. The linkage mechanism as recited in claim 13, wherein said headrest mounting linkage comprising a first mounting link, a second mounting link and a mounting plate, wherein said mounting plate is coupled with said first and second mounting links, and wherein said first and second mounting links are coupled with said back support linkage.

16. The linkage mechanism as recited in claim 15, wherein said toggle link coupled with an intermediate portion of said second mounting link.

17. The linkage mechanism as recited in claim 13, further comprising a first stop pin mounted on said back support linkage and positioned to contact a portion of said headrest mounting linkage when in the closed position to prevent said headrest mounting linkage from moving beyond the closed position.

18. The linkage mechanism as recited in claim 17, further comprising a second stop pin mounted on said back support linkage and positioned to contact a portion of said headrest mounting linkage when in a support position to prevent said headrest mounting linkage from moving beyond the support position.

19. The linkage mechanism as recited in claim 18, further comprising a third stop pin mounted on said back support linkage and positioned to contact a portion of said headrest bell crank to maintain the position of said headrest bell crank relative to said back support linkage when the chair moves between an intermediate position and a fully reclined position.

20. The linkage mechanism as recited in claim 13, further comprising a rock blocker linkage coupled with said seat mounting linkage and the base, wherein a portion of said rock blocker linkage is selectively coupled with said base to prevent the chair from rocking relative to the base when said footrest extension linkage is in the extended position.

21. The linkage mechanism as recited in claim 13, further comprising a handle actuating mechanism coupled with said seat mounting linkage and said footrest extension linkage, wherein said handle actuating mechanism is selectively positioned to prevent said seat mounting linkage from moving relative to the rocker cam assembly when said footrest extension linkage is in the retracted position.

22. The linkage mechanism as recited in claim 13, wherein said pop-up linkage is adapted to recess the headrest within the backrest when said footrest extension linkage is in the retracted position.

23. A linkage mechanism for a rocker-recliner chair having a base, a seat, a footrest, a backrest and a headrest, said linkage mechanism comprising:

a rocker cam assembly mounted on the base;

a seat mounting linkage coupling the seat to the rocker cam assembly;

a footrest extension linkage coupled with the seat mounting linkage and having the footrest mounted thereto;

a drive linkage coupling said seat mounting linkage with said footrest extension linkage, said drive linkage adapted to drive said footrest extension linkage from a retracted position to an extended position;

a back support linkage coupled with said seat mounting linkage and having the backrest mounted thereto;

a headrest mounting linkage coupled with said back support linkage and having the headrest coupled thereto; and a pop-up linkage including a headrest drive link having upper and lower portions, a headrest bell crank having first and second end portions, and a toggle link, said lower portion of said headrest drive link is coupled with said drive linkage and said upper portion is coupled with said first end portion of said headrest bell crank, said toggle link is coupled with said second end portion of said headrest bell crank and said headrest mounting linkage, and an intermediate portion of said headrest bell crank is pivotally coupled with said back support linkage at a point located rearwardly and below the connection between said upper portion of said headrest drive link and said first end portion of said headrest bell crank when said footrest extension linkage is in the extended position, wherein said lower portion of said headrest drive link moves forwardly as said drive linkage drives said footrest extension linkage to the extended position whereby said upper portion of said headrest drive link rotates said headrest bell crank in a counterclockwise direction relative to said back support linkage to place said headrest mounting linkage in a support position, and wherein said lower portion of said headrest drive link moves rearwardly as said footrest extension linkage is moved to a retracted position whereby said upper portion of said headrest drive link rotates said headrest bell crank in a clockwise direction relative to said back support linkage to place said headrest mounting linkage in a closed position.

24. The linkage mechanism as recited in claim 23, further comprising a spring coupled with said back support linkage and said upper portion of said headrest drive link for biasing said pop-up linkage toward the support position.

25. The linkage mechanism as recited in claims 23, wherein said headrest mounting linkage comprising a first mounting link, a second mounting link and a mounting plate, wherein said mounting plate is coupled with said first and second mounting links, and wherein said first and second mounting links are coupled with said back support linkage.

26. The linkage mechanism as recited in claim 25, wherein said toggle link coupled with an intermediate portion of said second mounting link.

27. The linkage mechanism as recited in claim 23, further comprising a first stop pin mounted on said back support linkage and positioned to contact a portion of said headrest mounting linkage when in the closed position to prevent said headrest mounting linkage from moving beyond the closed position.

28. The linkage mechanism as recited in claim 27, further comprising a second stop pin mounted on said back support linkage and positioned to contact a portion of said headrest mounting linkage when in a support position to prevent said headrest mounting linkage from moving beyond the support position.

29. The linkage mechanism as recited in claim 28, further comprising a third stop pin mounted on said back support linkage and positioned to contact a portion of said headrest bell crank to maintain the position of said headrest bell crank relative to said back support linkage when the chair moves between an intermediate position and a fully reclined position.

30. The linkage mechanism as recited in claim 23, further comprising a rock blocker linkage coupled with said seat mounting linkage and the base, wherein a portion of said rock blocker linkage is selectively coupled with said base to prevent the chair from rocking relative to the base when said footrest extension linkage is in the extended position.

31. The linkage mechanism as recited in claim 23, further comprising a handle actuating mechanism coupled with said seat mounting linkage and said footrest extension linkage, wherein said handle actuating mechanism is selectively positioned to prevent said seat mounting linkage from moving relative to the rocker cam assembly when said footrest extension linkage is in the retracted position.

32. The linkage mechanism as recited in claim 23, wherein said pop-up linkage is adapted to recess the headrest within the backrest when said footrest extension mechanism is in the retracted position.

33. A rocker recliner chair having a base, a seat, a backrest, a headrest and a pair of linkage mechanisms for supporting the seat and backrest for movement between upright, intermediate and fully reclined positions, each of said linkage mechanisms comprising:

a seat mounting linkage coupling the seat to the rocker cam assembly;

a footrest extension linkage coupled with the seat mounting linkage and having the footrest mounted thereto;

a drive linkage coupling said seat mounting linkage with said footrest extension linkage, said drive linkage adapted to drive said footrest extension linkage from a retracted position to an extended position;

a back support linkage coupled with said seat mounting linkage and having the backrest mounted thereto, said backrest support linkage capable of moving relative to said seat mounting linkage to place the chair in the fully reclined position after said footrest extension linkage is placed in the extended position;

a headrest mounting linkage coupled with said back support linkage and having the headrest coupled thereto; and a pop-up linkage including a headrest drive link having upper and lower portions, a headrest bell crank having first and second end portions, and a toggle link, said lower portion of said headrest drive link is coupled with said drive linkage and said upper portion is coupled with said first end portion of said headrest bell crank, said toggle link is coupled with said second end portion of said headrest bell crank and said headrest mounting linkage, and an intermediate portion of said headrest bell crank is pivotally coupled with said back support linkage, wherein said lower portion of said headrest drive link moves forwardly as said drive linkage drives said footrest extension linkage to the extended position whereby said upper portion of said headrest drive link rotates said headrest bell crank in a counterclockwise direction relative to said back support linkage as said drive linkage drives said footrest extension linkage to the extended position thereby placing said headrest mounting linkage in a support position, wherein said pop-up linkage operates to maintain the position of said headrest mounting linkage relative to said back support linkage as the chair moves to the fully reclined position, and wherein said lower portion of said headrest drive link moves rearwardly as said footrest extension linkage is moved to a retracted position whereby said upper portion of said headrest drive link rotates said headrest bell crank in a clockwise direction relative to said back support linkage when said footrest extension mechanism is moved to a retracted position thereby placing said headrest mounting linkage in a closed position.

34. The rocker recliner chair as recited in claim 33, further comprising a spring coupled with said back support linkage and said upper portion of said headrest drive link for biasing said pop-up linkage toward the support position.

35. The rocker recliner chair as recited in claim 33, wherein said headrest mounting linkage comprising a first mounting link, a second mounting link and a mounting plate, wherein said mounting plate is coupled with said first and second mounting links, and wherein said first and second mounting links are coupled with said back support linkage.

36. The rocker recliner chair as recited in claim 35, wherein said toggle link coupled with an intermediate portion of said second mounting link.

37. The rocker recliner chair as recited in claims 33, further comprising a first stop pin mounted on said back support linkage and positioned to contact a portion of said headrest mounting linkage when in the closed position to prevent said headrest mounting linkage from moving beyond the closed position.

38. The linkage mechanism as recited in claim 37, further comprising a second stop pin mounted on said back support linkage and positioned to contact a portion of said headrest mounting linkage when in a support position to prevent said headrest mounting linkage from moving beyond the support position.

39. The rocker recliner chair as recited in claim 38, further comprising a third stop pin mounted on said back support linkage and positioned to contact a portion of said headrest bell crank to maintain the position of said headrest bell crank relative to said back support linkage when the chair moves between the intermediate position and the fully reclined position.

40. The rocker recliner chair as recited in claim 33, further comprising a rock blocker linkage coupled with said seat mounting linkage and the base, wherein a portion of said rock blocker linkage is selectively coupled with said base to prevent the chair from rocking relative to the base when said footrest extension linkage is in the extended position.

41. The rocker recliner chair as recited in claim 33, further comprising a handle actuating mechanism coupled with said seat mounting linkage and said footrest extension linkage, wherein said handle actuating mechanism is selectively positioned to prevent said seat mounting linkage from moving relative to the rocker cam assembly when said footrest extension linkage is in the retracted position.

42. The rocker recliner chair as recited in claim 33, wherein said pop-up linkage is adapted to recess the headrest within the backrest when the chair is in the upright position.

43. A rocker-recliner chair having a base, a seat, a backrest, a headrest and a pair of linkage mechanisms for supporting the seat and backrest for movement between upright, intermediate and fully reclined positions, each of said linkage mechanisms comprising:

a rocker cam assembly mounted on the base;

a seat mounting linkage coupling the seat to the rocker cam assembly;

a footrest extension linkage coupled with the seat mounting linkage and having the footrest mounted thereon;

a drive linkage coupling said seat mounting linkage with said footrest extension linkage, said drive linkage adapted to drive said footrest extension linkage from a retracted position to an extended position;

a back support linkage coupled with said seat mounting linkage and having the backrest mounted thereto, said backrest support linkage capable of moving relative to said seat mounting linkage to place the chair in the fully reclined position after said footrest extension linkage is placed in the intermediate position;

a headrest mounting linkage coupled with said back support linkage and having the headrest coupled thereto;

a pop-up linkage including a headrest drive link and a headrest bell crank, said headrest bell crank coupled with said headrest drive link and being pivotally coupled with said back support linkage, said headrest drive link being coupled with said drive linkage;

means for rotating said headrest drive link in a counter-clockwise direction relative to said back support linkage as said drive linkage drives said footrest extension linkage to the extended position to place said headrest mounting linkage in a support position;

means for maintaining the position of said headrest mounting linkage relative to said back support linkage as the chair moves to the fully reclined position;

means for rotating said headrest bell crank in a clockwise direction relative to said back support linkage when said footrest extension mechanism is moved to a retracted position to place said headrest mounting linkage in a closed position; and means for preventing said seat mounting linkage from rocking relative to the base when said footrest extension mechanism is in the extended position.

44. The chair as recited in claim 43, wherein the linkage mechanism further includes means for preventing said headrest mounting linkage from rotating beyond the support position.

45. The chair as recited in claim 43, wherein the linkage mechanism further includes means for preventing said headrest mounting linkage from rotating beyond the closed position.

46. The chair as recited in claim 43, wherein the linkage mechanism further including actuating means for allowing said footrest extension linkage to be placed in the extended position.

47. The chair as recited in claim 43, further comprising means for recessing the headrest within the backrest when the chair is in the upright position.

* * * * *